United States Patent [19]

Humble

[11] 4,299,870

[45] Nov. 10, 1981

[54] REUSABLE THEFT DETERRENT SECURITY TAG

[75] Inventor: David R. Humble, Coral Springs, Fla.

[73] Assignee: Sensormatic Electronics Corporation, Deerfield Beach, Fla.

[21] Appl. No.: 153,777

[22] Filed: May 27, 1980

[51] Int. Cl.[3] ..... A44B 21/00; B65D 33/34; G09F 3/12

[52] U.S. Cl. ..... 428/101; 24/16 PB; 292/316; 428/916

[58] Field of Search ..... 40/21 C; 292/316; 24/16 PB; 294/99 R; 428/101, 916

[56] References Cited

U.S. PATENT DOCUMENTS

| | | | |
|---|---|---|---|
| 3,744,104 | 7/1973 | Ford | 40/21 C X |
| 3,942,829 | 3/1976 | Humble et al. | 292/316 |
| 3,974,581 | 8/1976 | Martens et al. | 340/572 X |
| 3,995,900 | 12/1976 | Humble et al. | 292/316 |
| 4,063,229 | 12/1977 | Welsh et al. | 206/387 X |
| 4,139,844 | 2/1979 | Reeder | 340/572 |

*Primary Examiner*—Henry F. Epstein

*Attorney, Agent, or Firm*—Hopgood, Calimafde, Kalil, Blaustein & Judlowe

[57] ABSTRACT

A device, detectable by automatic means, is concealed within a spring-tong-like housing structure formed from plastic arms joined at one end by a concealed bayonet type locking arrangement that creates a non-mobile joint. The arms are sufficiently flexible to permit their free ends to be pressed together manually thereby engaging a tack shank carried by one arm in a clutch lock concealed in the other arm. The intermediate portions of the arms have reduced structural rigidity such that any attempt to bend the housing structure when the tag is closed will result in flexure of the intermediate portions absorbing the bending forces with reduced communication of shearing force to mating end portions of the arms.

10 Claims, 17 Drawing Figures

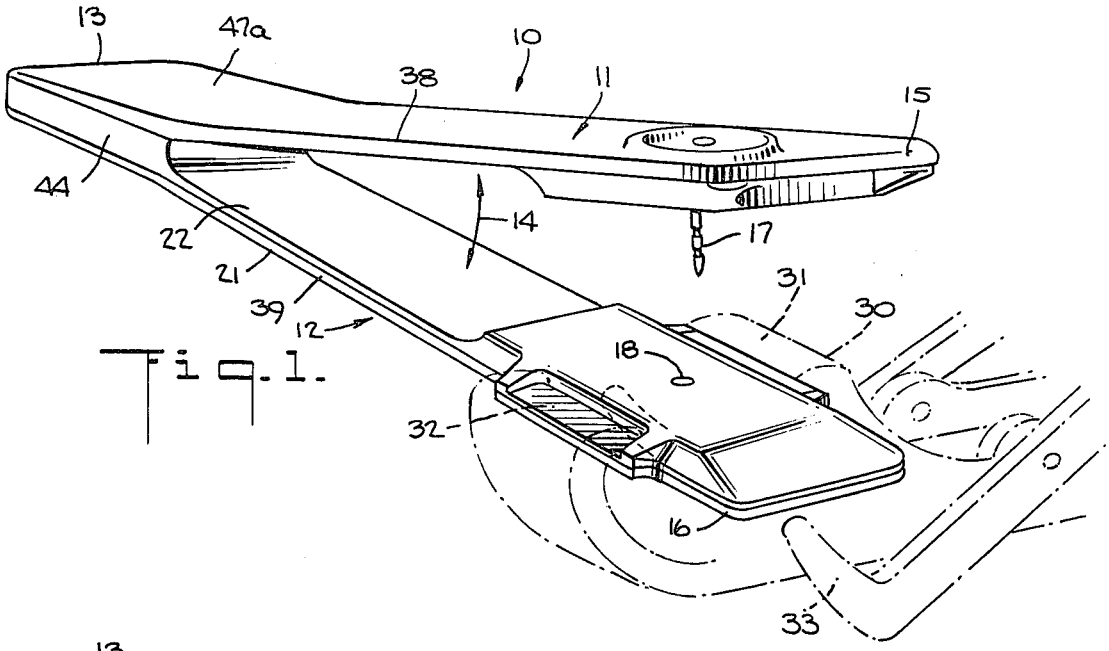
Fig. 1.
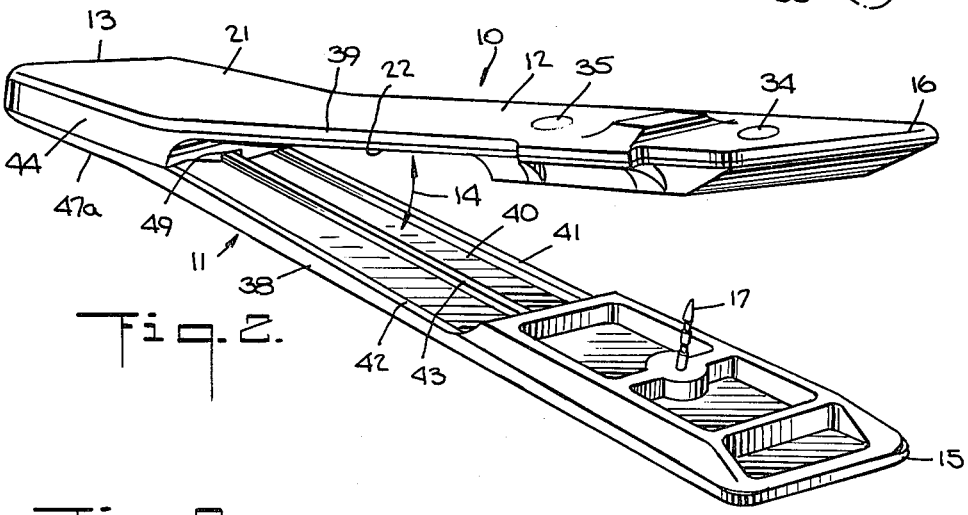
Fig. 2.
Fig. 3.
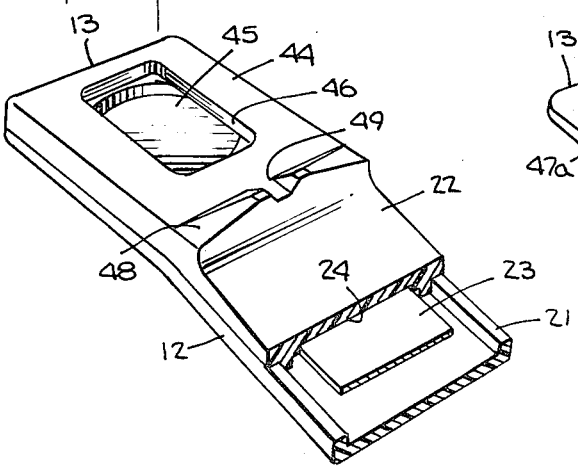
Fig. 4.
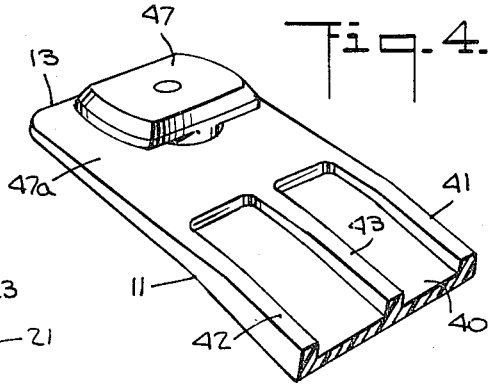

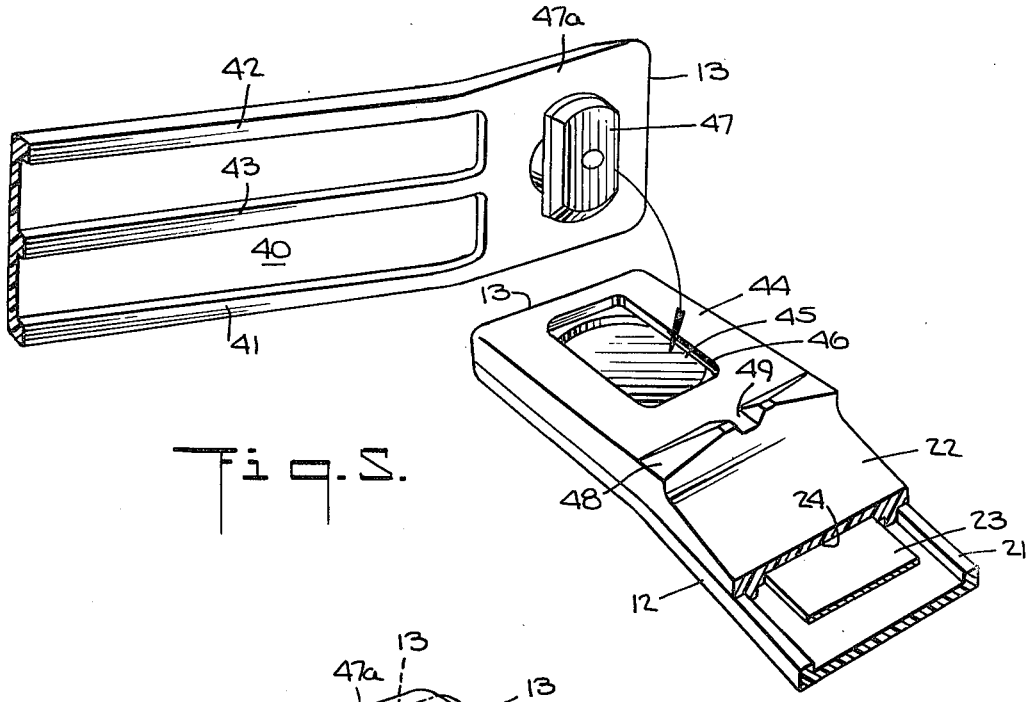
Fig. 5.
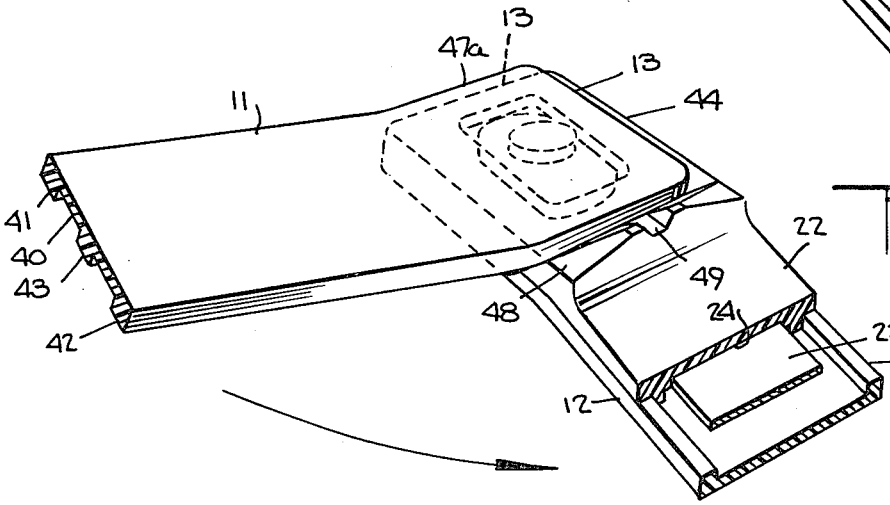
Fig. 6.
Fig. 7.
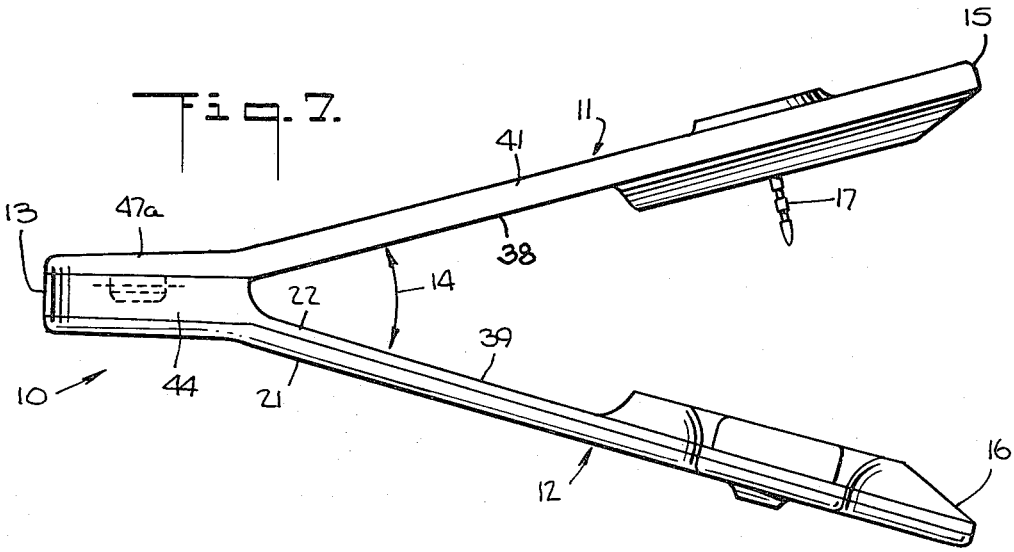

12
22
24
26
29
25
27
23
28
37
19
36
12
20
18
12
11
45
21
46
44
11

23
24
22
46
45
49
48

23
27
26
22
20
19
28
18
21

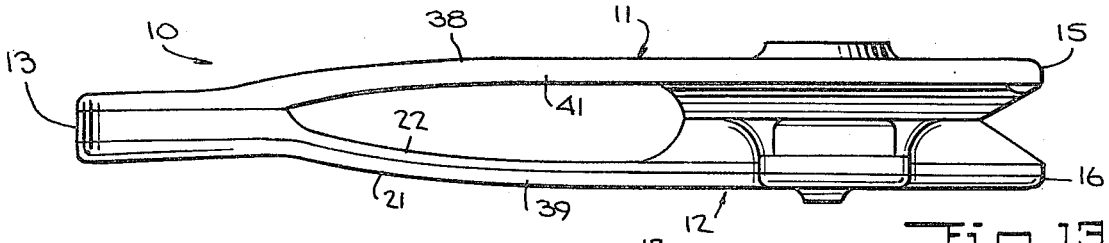
Fig. 13.
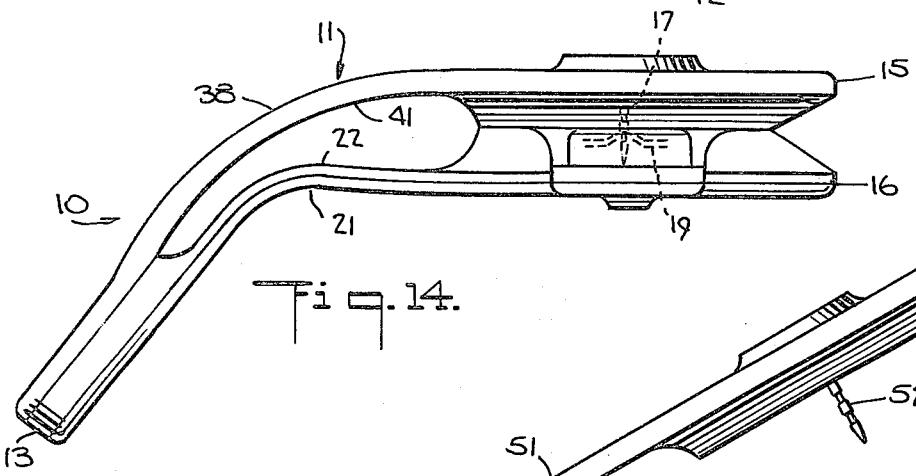
Fig. 14.
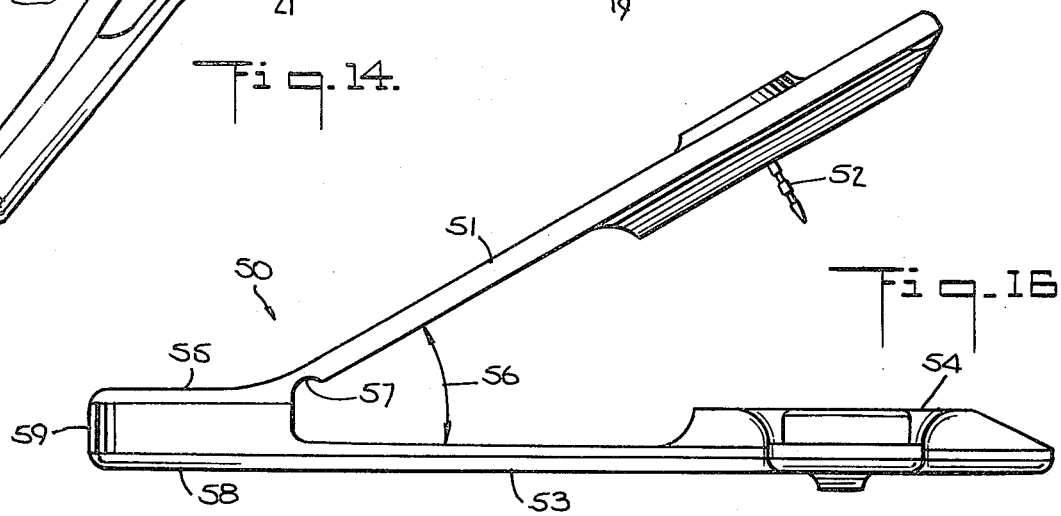
Fig. 16.
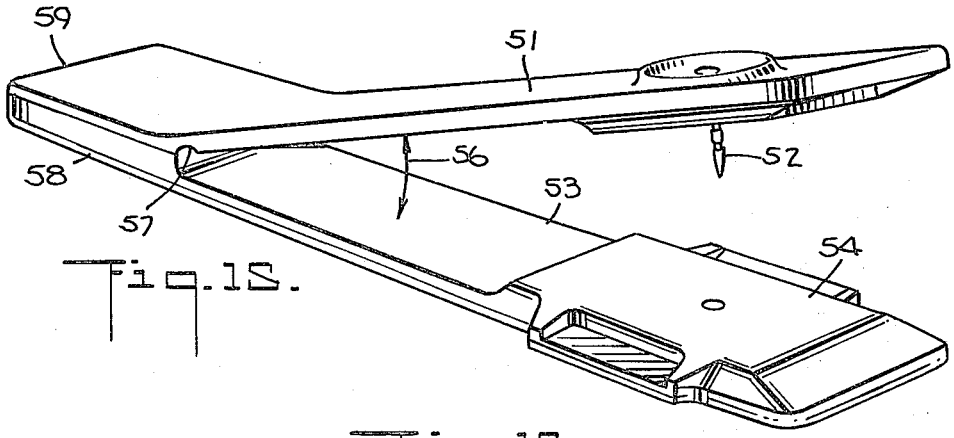
Fig. 15.
Fig. 17.
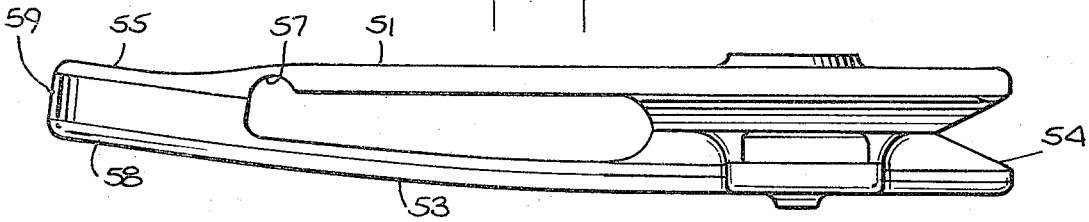

REUSABLE THEFT DETERRENT SECURITY TAG

BACKGROUND OF THE INVENTION

The present invention relates to a reusable security tag adapted to be secured to an article to be maintained under surveillance, and more particularly to a tag concealing an element detectable by independent means.

In U.S. Pat. No. 3,942,829 issued Mar. 9, 1976, on an application of David Raymond Humble and Harry Godfrey Walters, III, and assigned to the same assignee as the present invention, there is disclosed a reusable security tag having an enclosure containing an element detectable by independent means and a cruciate sheet metal clutch lock. A pin for piercing a garment is secured at the end of a lever arm which is hinged to said enclosure for controlled movement into said lock. Said pin is released from said clutch lock by application of a special tool to said enclosure for deforming the clutch lock to spread its jaws. For a more complete description of such reusable security tag reference should be had to the patent specification.

While a very considerable number of security tags constructed in accordance with the teaching of the aforesaid patent have been produced and used successfully, it has been discovered that such tags have certain limitations. The known tag is quite bulky and was constructed with a large knob or protuberance as a part of the housing to conceal the fastening tack when the tag is secured to a garment. It was discovered that when such tags are used in conjunction with garments that are normally tried on before purchase, the tags cause annoyance if they are secured to the garment with the protuberance of the housing located towards the inside of the article. Thus, in order to avoid such annoyance the retailers prefer to attach the tag to the garment with the tack end on the inside which means that during normal application of the tag to the garment the tack would be concealed from view by the garment and more difficult to locate at a specific spot.

It was also discovered as a consequence of considerable use of such patented tags that they could be defeated by continual flexing and bending by an individual intent upon unauthorized removal of the tag. Apparently, in spite of the specific measures taken to reduce the same, flexing of the tag results in the communication of severe shearing forces to the tack clutch lock area causing the lock gradually to give. Also, since the patented tag is constructed with a lever arm that is hinged to an enclosure, the exposed hinge is subject to attack and destruction enabling the tag to be removed without authorization.

SUMMARY OF THE INVENTION

Bearing in mind the foregoing, it is an object of the present invention to eliminate the mentioned disadvantages. It is a further object of the present invention to provide a more secure, lighter weight, thinner profile tag than that known heretofore.

In accordance with one aspect of the present invention, there is provided a reusable security tag comprising a spring-tong-like housing structure having two arms that are joined together at one end by a non mobile joint and constrained by such joint to extend divergently from said one end at a predetermined acute angle which angle is maintained in the absence of any flexing of said arm. The said structure is constructed and arranged to be resiliently deflectable through flexing of at least one of said arms to permit the free ends of said arm to be brought together under direct manual pressure. The free end of one of the arms carries a tack shank and the free end of the other arm carries clutch lock means for receiving and gripping said tack shank. The clutch lock means is concealed within a hollow cavity in the arm but manipulable by a mechanical aid acting by way of the walls of said housing structure to release the tack shank. A device that is automatically detectable when present in a surveillance zone is enclosed within one of the arms of said housing structure.

In accordance with a further aspect of the subject invention, the arms are proportioned and constructed of such material that portions at the ends of the arms are comparatively stiff and resistant to direct manual flexure while the intermediate portions of the arms are so constructed as to manifest suppleness in comparison to the end portions such that any attempt to bend the housing structure will result in flexure of the intermediate portions absorbing the bending forces with reduced communication of shearing force to mating end portions of the arms.

BRIEF DESCRIPTION OF THE DRAWINGS

The invention will be better understood after reading the following detailed description of the presently preferred embodiments thereof with reference to the appended drawings in which:

FIG. 1 is a perspective view of a reusable tag embodying the subject invention and showing the interrelationship of a hand operated release tool;

FIG. 2 is an inverted perspective view of the tag of FIG. 1;

FIG. 3 is a fragmentary perspective view of the heel portion at one end of one of the arms of the tag of FIG. 1 showing the receiving cavity for a locking arrangement for securing the arms together;

FIG. 4 is a view similar to FIG. 3 but of the corresponding end of the other arm of the tag showing the flanged boss that cooperates with the receiving cavity shown in FIG. 3;

FIG. 5 is a perspective view showing the two arms of the tag in position about to be assembled;

FIG. 6 shows the same two arms after insertion of the flanged boss into the receiving cavity but prior to completion of the assembly thereof;

FIG. 7 is a side elevational view of the tag shown in FIG. 1 to more clearly illustrate the symmetrical divergence of the arms;

FIG. 13 is a side elevational view of the tag described with reference to FIGS. 1 to 12 showing the relationship of the parts when in closed position;

FIG. 14 is a side view of the closed tag of FIG. 13 but illustrating the absorption of forces by the intermediate portions of the arms when the tag is flexed;

FIG. 15 is a perspective view, similar to FIG. 1, showing a modification of the tag but with the release tool omitted;

FIG. 16 is a side elevational view of the tag of FIG. 15 to better illustrate the asymmetric opening of the arms and the hinge line included therein; and FIG. 17 is a side elevational view of the tag of FIGS. 15 and 16 but showing the arms in closed position.

DESCRIPTION OF THE PREFERRED EMBODIMENT

Figures 8, 11, 12:
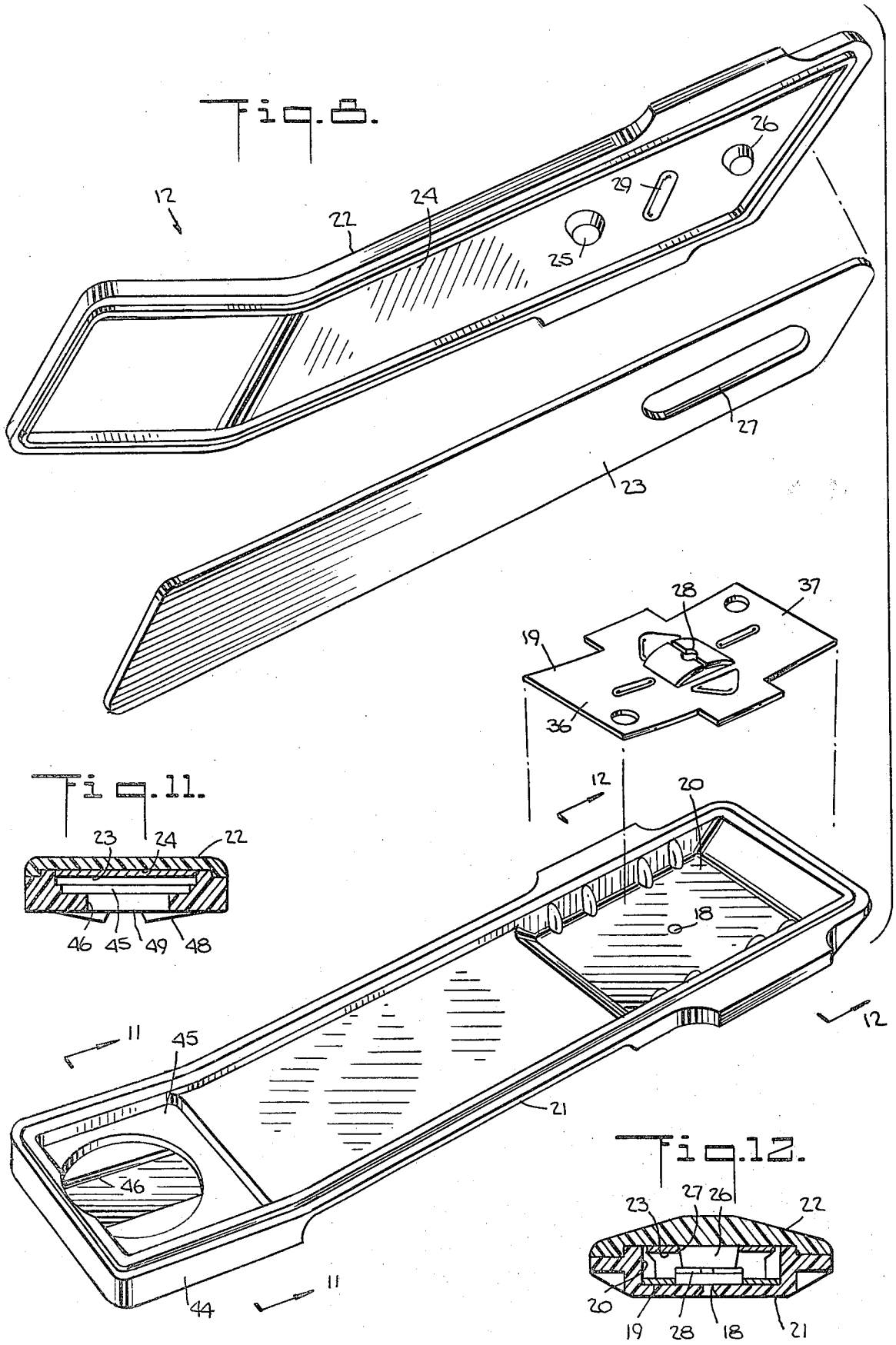
FIG. 8 is an exploded view of the components that constitute that arm of the tag that conceals the detectable element and the clutch lock member.
FIG. 11 is a transverse sectional view taken along the line 11—11 in FIG. 8.
FIG. 12 is a transverse sectional view taken along the line 12—12 in FIG. 8.
Figure 9:
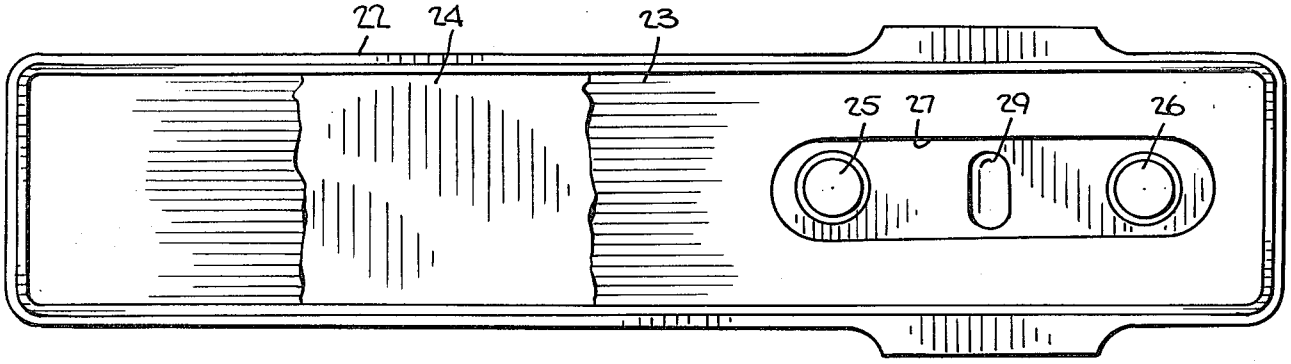
FIG. 9 is a plan view of one of the components of the arm that has been illustrated in FIG. 8 showing the detectable element in position.

Reference should now be had to the drawings wherein the same reference numerals are used throughout to designate the same or similar parts.

Referring specifically to FIGS. 1 and 2, the reusable security tag constructed in accordance with the present invention is designated generally by the reference numeral 10. It is shown as consisting of a spring-tong-like housing structure having two arms, 11 and 12, that are joined together at one end, 13, by a non mobile joint and constrained by such joint to extend divergently from said end 13 at a predetermined acute angle indicated by the double headed arrow 14. The entire housing structure is constructed of plastic material having both the necessary toughness and resiliency as will be understood from the ensuing description, such that the arms 11 and 12 are maintained spread at the angle 14 in the absence of any flexing of the arms. However, the arms 11 and 12 are sufficiently resilient that they can be flexed and deflected by manual manipulation to permit the free ends 15 and 16 to be brought together. This is normally effected at the time the tag is to be attached to a garment or other penetrable article which would be placed between the ends 15 and 16. When the arms 11 and 12 are brought together the tack shank 17 carried by the end 15 of arm 11 is forced through the article whereupon it enters the aperture 18 in the end 16 to be engaged by a concealed clutch lock whose details may be seen in FIGS. 8 and 10 to which attention should now be directed.

Figure 10:
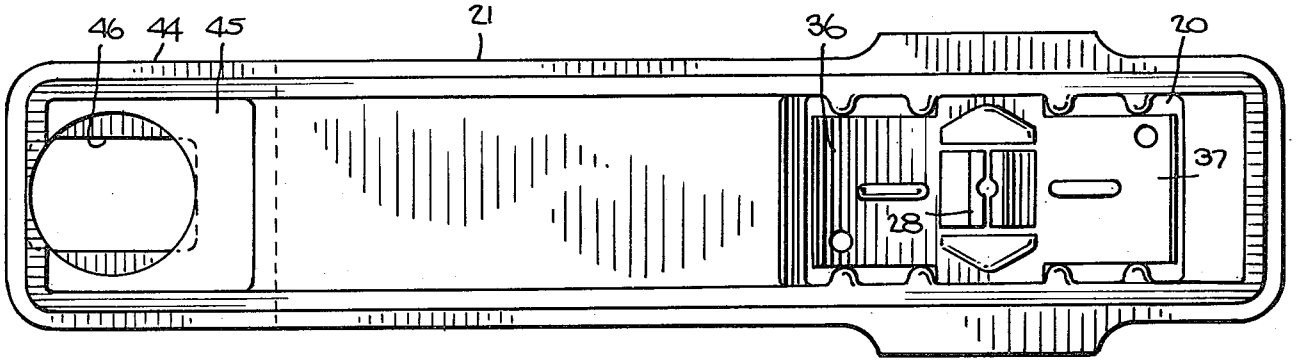
FIG. 10 is a similar plan view of the other component of the arm shown in FIG. 8 with the clutch lock in position.

As seen in FIGS. 8 and 10, the clutch lock 19 is concealed within a hollow cavity 20 in the arm 12 which cavity is formed within an arm section or component 21. The remainder of arm 12 consists of a cover section or component 22 that mates with the component 21 and may be bonded thereto by ultrasonic welding or other suitable means.

An automatically detectable device 23, the details of which form no part of the present invention, that is detectable by electronic or electrical means, is disposed within a recess 24 in the arm component 22 with the bosses 25 and 26 on the component 22 projecting through the slot 27 in the detectable device 23. When the arm components 21 and 22 are assembled the device 23 will be disposed over the clutch lock member 19 with the jaws 28 of the clutch lock projecting through the slot 27. Directly over the gap between the jaws 28 is a clearance depression 29 in the component 22 for receiving the point end of tack shank 17 when the latter is engaged between jaws 28. Operation of the clutch lock 19 is more fully described in the aforesaid patent, while the nature of device 23 may be learned, for example, from U.S. Pat. Nos. 4,063,229 and 4,139,844.

Returning to FIG. 1, there is shown in phantom a mechanical aid 30 in the form of a plier-like tool for releasing a closed tag structure. The end 16 of arm 12 is engaged by restraining lips 31 and 32 while fingers, of which only finger 33 is visible in the drawing, engage the underside of the end 16 to apply pressure through the housing to the clutch lock to spread the jaws 28 thereby releasing the tack shank 17. In FIG. 2 the arm 12 is seen provided with dimpled areas 34 and 35 which areas are engaged by the fingers of the release tool 30. The dimples 34 and 35 are located directly above the bosses 25 and 26, best seen in FIG. 8, such that the force applied by the fingers of tool 30 at the dimpled points 34 and 35 are communicated through the bosses 25 and 26 to the arms 36 and 37 of the clutch lock 19.

FIGS. 7 and 13 illustrate the security tag 10, respectively, in its open and closed positions as viewed from the side. From such views it will be observed that the arms 11 and 12 are proportioned such that the ends 13, 15 and 16 are comparatively stiff and resistant to direct manual flexure while the intermediate portions 38 and 39 of the arms 11 and 12, respectively, are reduced in thickness and constructed to manifest suppleness in comparison to the end portions. When the tag structure is closed as shown in FIG. 13 and an attempt is made to bend the housing structure 10, such bending will result, as shown in FIG. 14, in flexure of the intermediate portions 38 and 39 which flexure absorbs the bending forces with reduced communication of any shearing force to the mating end portions of the arms. The particular consequences of this is to avoid the application of stress to the tack shank and clutch lock that might result in unauthorized opening of the lock as well as to prevent forces being applied to the opposite end of the tag structure that might cause the joint between the arms 11 and 12 to separate.

As best seen in FIG. 2, the intermediate portion 38 of arm 11 consists of a thin wall 40 in the plane of the arm with reinforcing ribs 41 and 42 normal to the wall 40 along opposite side edges thereof. The ribs 41 and 42 are proportioned to resist cutting with a tool across the arm while not preventing the flexure of said intermediate portion as described above. In addition, a central rib 43 is provided both to tailor the rigidity of the portion of the arm and for a purpose to be explained hereinafter.

The individual arms 11 and 12 of the tag structure 10 are constructed separately and then joined together at the end 13. For this purpose, the arm 12 has a heel portion 44 at its end 13 containing a receiving cavity 45 with a rectangular aperture 46 for receiving and capturing the flanged boss 47 of a bayonet locking arrangement. The flanged boss 47 is disposed on the heel portion **47*a* at the end 13 of arm 11**.

In order to assemble arm 11 to arm 12 the flanged boss 47 is inserted into the receiving cavity 45 as shown in sequence in FIGS. 5 and 6, whereupon the arm 11 is rotated 90° relative to the arm 12 so that the arms become aligned with the rib 43 riding up the inclined surface 48 to become engaged in the notch, 49, as best seen in FIG. 2. The configuration of the notch 49 is related to that of the rib 43 so as to resist forces tending to rotate the arms relative to each other which would disassemble the joint although not rendering such disassembly impossible when the tag is in open condition. However, it will be appreciated that once the tag has been closed with the tack shank 17 engaged by the clutch lock 19 the joint formed between the receiving cavity 45 and the flanged boss 47 is concealed and cannot be separated.

Referring to FIG. 7, it will be observed that both of the arms 11 and 12 have the extending portion of its arm angled obtusely from its corresponding heel portion with such angle being the supplement of one half of the angle 14 that separates the arms in open condition.

Referring now to FIGS. 15, 16 and 17, there is illustrated therein a modification of the security tag embodying the present invention. The tag designated generally by the reference numeral 50 is shown as comprising one arm 51 carrying a tack 52 at its free extremity and a second arm 53 housing a clutch lock (not visible in the drawings) at its end 54. The arm 51 may be constructed substantially the same as the arm 11 in the embodiment previously described, with the exception that the obtuse angle formed between its extending portion and its heel portion 55 is supplemental to the acute angle 56 separating arm 51 from 53 when the tag is in open position. In addition, arm 51 is provided with a reduced thickness hinge line at 57, joining the heel portion 55 to the remainder of the arm.

Similarly, arm 53 in the embodiment of FIG. 16, is constructed substantially the same as the arm 12 in the previous embodiment with the exception that the heel portion 58 is co-planer with the remainder of the arm rather than being disposed at an obtuse angle thereto. In all other respects the tag shown in FIGS. 15, 16 and 17, is identical to that shown and described with reference to FIGS. 1–14. Thus, arms 51 and 53 are joined at the end 59 by a bayonet type locking joint identical to that described previously, and the tack 52 is arranged to enter a cavity within the end 54 of arm 53 to engage a clutch lock identical to that already described. It will be understood that in the embodiment described with reference to FIGS. 1–14 each of the arms is required to flex relative to their respective heel portions only half the angular distance that is required of arm 51 in the embodiment of FIGS. 15–17. Therefor, the reduced thickness hinge line 57 in the latter embodiment is not required in the embodiment of FIGS. 1–14. In fact, with appropriate choice of material and dimensions it may be permissable to omit the reduced thickness hinge line 57 in the embodiment of FIGS. 15–17.

Having described the presently preferred embodiments of the invention, it should be understood that various changes in details of construction may be incorporated without departing from the true spirit of the invention as defined in the appended claims.

What is claimed is:

1. A reusable security tag comprising a spring-tong-like housing structure having two arms that are joined together at one end by a non mobile joint and constrained by such joint to extend divergently from said one end at a predetermined acute angle which angle is maintained in the absence of any flexing of said arms; said structure being constructed and arranged to be resiliently deflectable through such flexing of at least one of said arms to permit the free ends of said arms to be brought together under direct manual pressure, the free end of one of said arms carrying a tack shank and the free end of the other arm carrying clutch lock means for receiving and gripping said tack shank, said clutch lock means being concealed within a hollow cavity in said other arm but manipulable by a mechanical aid acting by way of the walls of said housing structure to release said tack shank, and a device that is automatically detectable when present in a surveillance zone enclosed within one of said arms of said housing structure.

2. A reusable security tag according to claim 1, wherein said arms are proportioned and constructed of such material that portions at the ends of said arms are comparatively stiff and resistant to direct manual flexure while the intermediate portions of said arms are so constructed as to manifest suppleness in comparison to said end portions such that any attempt to bend said housing structure will result in flexure of said intermediate portions absorbing the bending forces with reduced communication of shearing force to mating end portions of said arms.

3. A reusable security tag according to claim 2, wherein the intermediate portion of one of said arms comprises a thin wall in the plane of the arm with reinforcing ribs normal to said wall along opposite side edges thereof, said ribs being proportioned to resist cutting with a tool across said arm while not preventing said flexure of said portion.

4. A reusable security tag according to claim 1, wherein one of said arms is planar while the other of said arms has a heel portion constituting a part of said joint joined parallel to an end of said one arm, and another portion angled obtusely from said heel portion supplementally to said acute angle, and a reduced thickness hinge line joining said heel portion to said another portion.

5. A reusable security tag according to claim 4, wherein said arms are proportioned and constructed of such material that portions at the ends of said arms are comparatively stiff and resistant to direct manual flexure while the intermediate portions of said arms are so constructed as to manifest suppleness in comparison to said end portions such that any attempt to bend said housing structure will result in flexure of said intermediate portions absorbing the bending forces with reduced communication of shearing force to mating end portions of said arms.

6. A reusable security tag according to claim 5, wherein the intermediate portion of said one arm comprises a thin wall in the plane of the arm with reinforcing ribs normal to said wall along opposite side edges thereof, said ribs being proportioned to resist cutting with a tool across said arm while not preventing said flexure of said portion.

7. A reusable security tag according to claim 1, wherein each of said arms has a heel portion at one end and another portion angled obtusely from the corresponding heel portion at an angle substantially equal to the supplement of one half of said acute angle, and said heel portions are joined in parallel relationship to form said joint.

8. A reusable security tag according to claim 7, wherein said arms are proportioned and constructed of such material that portions at the ends of said arms are comparatively stiff and resistant to direct manual flexure while the intermediate portions of said arms are so constructed as to manifest suppleness in comparison to said end portions such that any attempt to bend said housing structure will result in flexure of said intermediate portions absorbing the bending forces with reduced communication of shearing force to mating end portions of said arms.

9. A reusable security tag according to claim 8, wherein the intermediate portion of one of said arms comprises a thin wall in the plane of the arm with reinforcing ribs normal to said wall along opposite side edges thereof, said ribs being proportioned to resist cutting with a tool across said arm while not preventing said flexure of said portion.

10. A reusable security tag according to claim 1, wherein each of said arms has a heel portion at one end, one of said heel portions containing a receiving cavity forthe flanged boss of a bayonet locking arrangement and the other of said heel portions having a flanged boss thereon for locking engagement in said receiving cavity such that said heel portions are locked together in parallel relationship to provide said joint therebetween, said joint being locked and concealed when the longitudinal axis of both arms are co-planar, a condition that cannot be altered so long as said tack shank is captured in said clutch lock means.

* * * * *